US011794955B2

(12) United States Patent
Perez

(10) Patent No.: US 11,794,955 B2
(45) Date of Patent: Oct. 24, 2023

(54) BOTTLE-TOP ADAPTER

(71) Applicant: Reyna Dayana Perez, Paramount, CA (US)

(72) Inventor: Reyna Dayana Perez, Paramount, CA (US)

( * ) Notice: Subject to any disclaimer, the term of this patent is extended or adjusted under 35 U.S.C. 154(b) by 230 days.

(21) Appl. No.: 17/384,505

(22) Filed: Jul. 23, 2021

(65) Prior Publication Data

US 2022/0024644 A1 Jan. 27, 2022

Related U.S. Application Data

(63) Continuation-in-part of application No. 29/787,488, filed on Jun. 7, 2021.

(60) Provisional application No. 63/056,439, filed on Jul. 24, 2020.

(51) Int. Cl.

| | |
|---|---|
| ***B65D 41/04*** | (2006.01) |
| ***B65D 51/24*** | (2006.01) |
| ***B65D 51/18*** | (2006.01) |

(52) U.S. Cl.

CPC ..... *B65D 41/04* (2013.01); *B65D 51/18* (2013.01); *B65D 51/245* (2013.01); *B65D 2251/0015* (2013.01)

(58) Field of Classification Search

CPC .. B65D 41/0485; B65D 51/243; B65D 41/22; B65D 41/225

USPC ..... 215/305; 220/805

See application file for complete search history.

(56) References Cited

U.S. PATENT DOCUMENTS

| | | | | |
|---|---|---|---|---|
| 4,709,832 | A * | 12/1987 | Mantyla | B65D 43/0212 220/780 |
| 9,630,752 | B2 * | 4/2017 | Kooney | B65D 41/165 |
| 2008/0156815 | A1 * | 7/2008 | Coff | A47J 41/00 220/592.2 |
| 2010/0065201 | A1 * | 3/2010 | Means | G09F 3/0288 283/70 |
| 2011/0240589 | A1 * | 10/2011 | Averill | B65D 41/18 215/321 |

(Continued)

FOREIGN PATENT DOCUMENTS

| | | | | |
|---|---|---|---|---|
| CN | 202321010 | U | 7/2012 | |
| DE | 102005028992 | A1 * | 1/2007 | B65D 41/04 |

(Continued)

OTHER PUBLICATIONS

Vitrix Kitchenware Silicone Wine Bottle Caps, https://www.amazon.com/Vitrix-Kitchenware-Caps-Set-Unbreakable-Covers-Silicone/dp/B07CMXYYM3.

*Primary Examiner* — James N Smalley

(57) ABSTRACT

A bottle-top adapter is an apparatus that allows a user to retain a bottle cap for repeated use. The apparatus has a grip that extends beyond the width of the bottle cap retaining features, thus allowing enhanced leverage during use. A writable surface connected to the top of the gripping feature allows a user to indicate the owner and contents of the disposable bottle. A user may place or press a bottle cap into the cap-retaining segment of the apparatus to secure the bottle cap in place during use. The user may then grasp the grip, or other exposed features, and twist to open or close the disposable bottle. Upon completion, the user may remove the bottle cap from the cap-retaining segment of the apparatus to prepare the apparatus for subsequent usage upon another disposable bottle cap. Consequently, the apparatus may help in the reuse of disposable bottle caps.

5 Claims, 6 Drawing Sheets

(56) References Cited

U.S. PATENT DOCUMENTS

| | | | | |
|---|---|---|---|---|
| 2012/0138563 | A1 | 6/2012 | Brumfield | |
| 2014/0263317 | A1* | 9/2014 | Linder | B65D 41/045 220/212.5 |
| 2014/0374301 | A1 | 12/2014 | West | |
| 2020/0290778 | A1* | 9/2020 | May | B65D 41/0485 |

FOREIGN PATENT DOCUMENTS

| | | | |
|---|---|---|---|
| KR | 200365735 | * | 10/2004 |
| KR | 20090000135 | * | 1/2009 |

* cited by examiner

BOTTLE-TOP ADAPTER

The current application claims a priority to the U.S. Provisional Patent application Ser. No. 63/056,439 filed on Jul. 24, 2020.

The current application is also a continuation-in-part (CIP) application of the U.S. design application Ser. No. 29/787,488 filed on Jun. 7, 2021.

FIELD OF THE INVENTION

The present invention relates generally to a bottle cap cover. More specifically, the bottle-top adapter relates to a fixture that retains a bottle cap, especially a disposable twist-off water or sports drink bottle cap. The present invention is also able to twist to attach or remove the bottle cap from the top of the bottle.

BACKGROUND OF THE INVENTION

Pollution and environmental waste continuously plague Earth as humanity's carbon footprint continues to grow. The impact of waste collecting in landfills affects water quality and wildlife around the world. Landfills in particular continue to fill with disposable garbage that will not degrade naturally for hundreds or thousands of years, if not longer. In order to mitigate the effects of the harmful waste, the most effective response is to reduce and reuse items that would otherwise be disposed of and added to the waste pile.

There are a variety of suboptimal solutions that have been developed to address this issue. Recycling has been reasonably successful at repurposing disposed-of material into new products. Unfortunately, many of these solutions, including recycling and more advanced methods of managing waste, do not leverage the ability of people to reuse their items before disposing of them. Disposable bottles in particular generate a lot of waste that can be mitigated through reuse, but that still continues to contribute a large amount of annual waste to landfills. While the bottle caps are often reusable across different bottles, they are all too often lost due to being misplaced or tossed due to the inconvenience of retaining a disposable bottle cap for the next use. What is needed is a device that can retain a disposable bottle cap during use. Further desirable is a device that can indicate the contents of a bottle.

The present invention addresses these issues. More specifically, the present invention is a bottle-top adapter that allows a user to retain a bottle cap for repeated use. The present invention has a grip that extends beyond the width of the cap-retaining features, thus allowing enhanced leverage during use. A writable surface connected to the top of the gripping feature allows a user to indicate the owner and contents of the disposable bottle. A user may place or press a bottle cap into the cap-retaining segment of the present invention in order to secure the bottle cap in place during use. The user may then grasp the grip or other exposed features and twist in order to open or close the disposable bottle. Upon completion, the user may remove the bottle cap from the cap-retaining segment of the present invention to prepare the present invention for subsequent usage upon another disposable bottle cap.

DETAILED DESCRIPTION OF THE INVENTION

All illustrations of the drawings are for the purpose of describing selected versions of the present invention and are not intended to limit the scope of the present invention.

Figure 1:
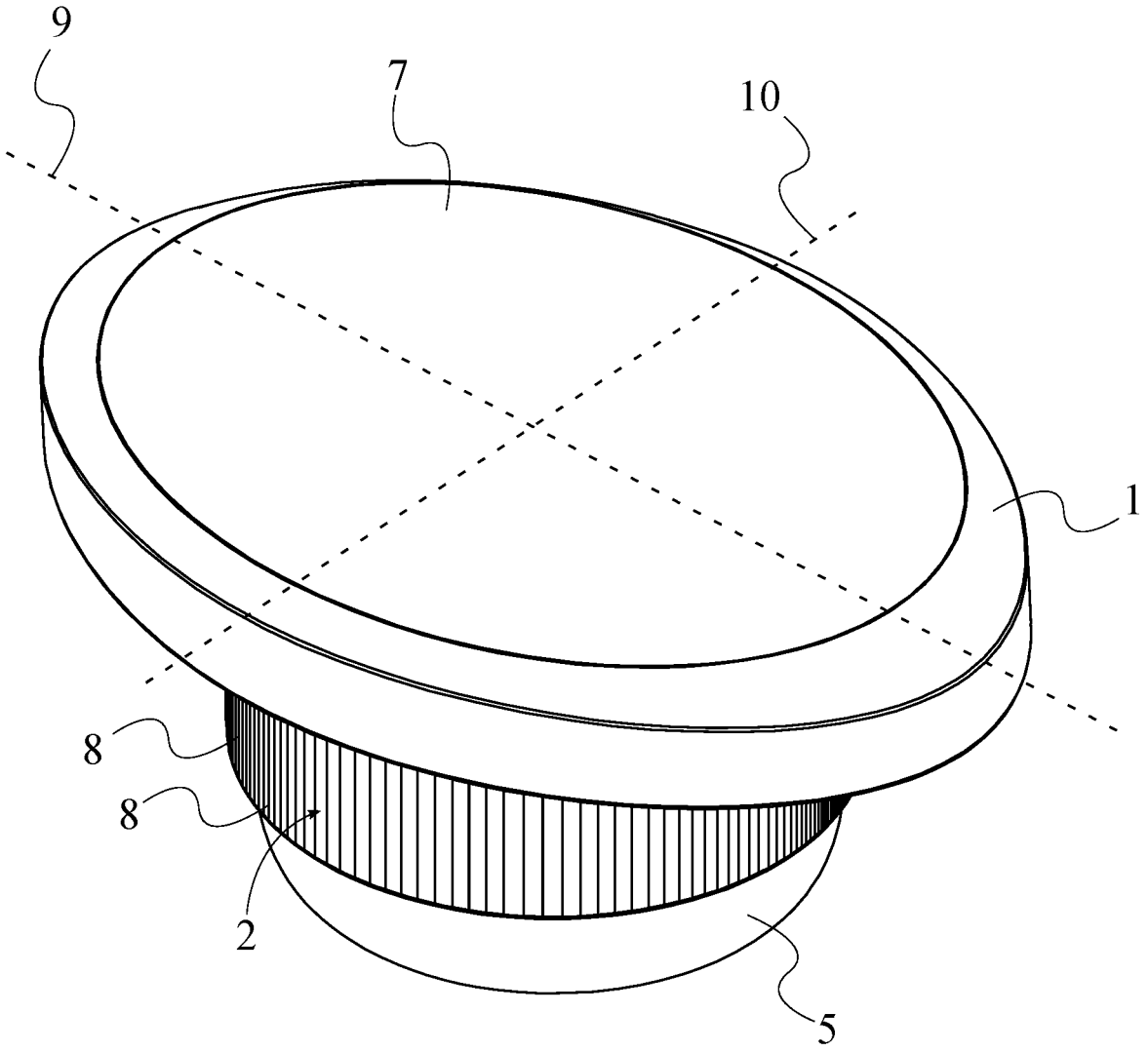
FIG. 1 is a top perspective view of the present invention.

The present invention is a bottle-top adapter that is used to retain the cap of a bottle, especially the cap of a disposable beverage bottle. The present invention is also configured to provide information regarding the contents and owner of the bottle. The present invention comprises a flange 1, a prismatic body 2, a bottle-sealing lip 5, and a primary cavity 6, as shown in FIG. 1. The flange 1 is the protruding edge which enables a user to grasp and twist the present invention in order to apply or remove a bottle cap from a bottle. The prismatic body 2 relates to the segment of the present invention that may retain the cap of a disposable bottle. The bottle-sealing lip 5 is a protrusion that prevents a contained bottle cap from exiting the prismatic body 2 undesirably. The primary cavity 6 is a cut into the prismatic body 2 which houses a bottle cap within the prismatic body 6 during the preferred usage of the present invention.

Figure 2:
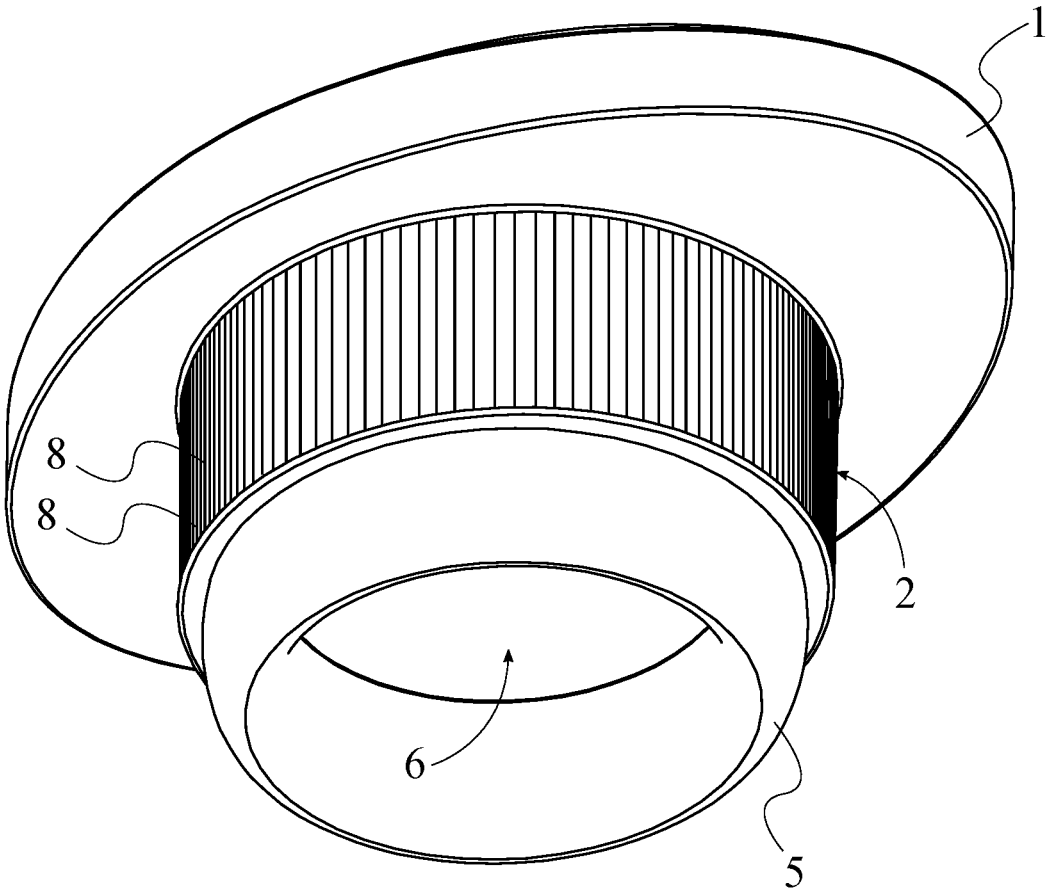
FIG. 2 is a bottom perspective view of the present invention.

The general configuration of the aforementioned components allows the present invention to efficiently and effectively retain and utilize a bottle cap relative to an associated bottle. The prismatic body 2 comprises a first base 3 and a second base 4, as shown in FIG. 2. The first base 3 is the segment of the prismatic body 2 that allows for orientation of the flange 1 relative to the prismatic body 2. The second base 4 is the segment of the prismatic body 2 that allows for orientation of the primary cavity 6 relative to the prismatic body 2. The first base 3 and the second base 4 are positioned opposite to each other about the prismatic body 2. Thus, the first base 3 may allow for orientation of components offset from the second base 4 about the prismatic body 2. The primary cavity 6 is concentrically positioned to the prismatic body 2. In this way, the primary cavity 6 is appropriately arranged to allow for support of a bottle cap during the preferred usage of the present invention. The primary cavity 6 traverses into the prismatic body 2 from the second base 4. This arrangement ensures that appropriate space is provided within the prismatic body 2 for a bottle cap. The flange 1 is laterally connected around the prismatic body 2, adjacent to the first base 3. In this way, the flange 1 may be conveniently utilized as a gripping mechanism opposite the second base 4. The bottle-sealing lip 5 is connected onto the second base 4. This arrangement allows the bottle-sealing lip 5 to support a bottle cap in position proximal to the second base 4. The bottle-sealing lip 5 is positioned around the primary cavity 6. Thus, the bottle-sealing lip 5 further enhances the ability of the primary cavity 6 to contain a bottle cap during use.

The present invention benefits from the addition of the ability to add custom visual indicators in order to distinguish different bottle-top adapters from each other. To this end, the present invention may further comprise a writable panel 7, as shown in FIG. 1. The writable panel 7 is a surface, such as a whiteboard, paper, or other such tools that enable writing and drawing, thus providing a suitable location for a user to communicate ownership, bottle contents, and more as desired. The writable panel 7 is connected onto the first base 3. In this way, the writable panel 7 is arranged so that the writable panel 7 is accessible to the user. The flange 1 is positioned around the writable panel 7. Thus, the writable panel 7 may be used to leave messages or written indications for the user.

It may be desirable to provide easily-adjustable, colorful content upon the writable panel 7. To this end, the writable panel 7 may be a miniaturized whiteboard. In this way, the user may write, edit, and remove content from the writable panel 7 as desired.

The present invention may further benefit from enhancement of the ability of the user to grasp the present invention during use. To this end, the present invention may further comprise a plurality of grip ridges 8, as shown in FIG. 3-6. The plurality of grip ridges 8 is a circular pattern of protrusions that allows for increased surface contact area during use. Each of the plurality of grip ridges 8 may be positioned along the prismatic body 2. This arrangement allows the plurality of grip ridges 8 to improve the ability of the user to grip and rotate the prismatic body 2. The plurality of grip ridges 8 is radially distributed about the prismatic body 2. Thus, the user may experience even contact with the plurality of grip ridges 8 during use. Each of the plurality of grip ridges 8 is laterally connected to the prismatic body 2. In this way, the plurality of grip ridges 8 is accessible to the user.

The present invention must be capable of adjusting to variable-sized bottles and caps, depending on desired usage. To this end, the flange 1, the prismatic body 2, and bottle-sealing lip 5 may be made of a semirigid polymeric material. This allows the present invention to both retain its shape and flex as needed to adapt to different bottle caps, and also ensures that the position of a bottle cap is sustained during use.

Several specific materials may meet the desired specifications. In particular, the semirigid polymeric material may be made of silicone. The use of silicone ensures that the semirigid polymeric material is both flexible and rigid as desirable.

The flange 1 may be shaped in order to both depress a bottle cap into the present invention and to twist the bottle cap onto or off of a bottle. To this end, the flange 1 may be an oblong shape. This arrangement allows for intuitive grasping, pressing, and twisting of the present invention by using the flange 1.

Figure 3:
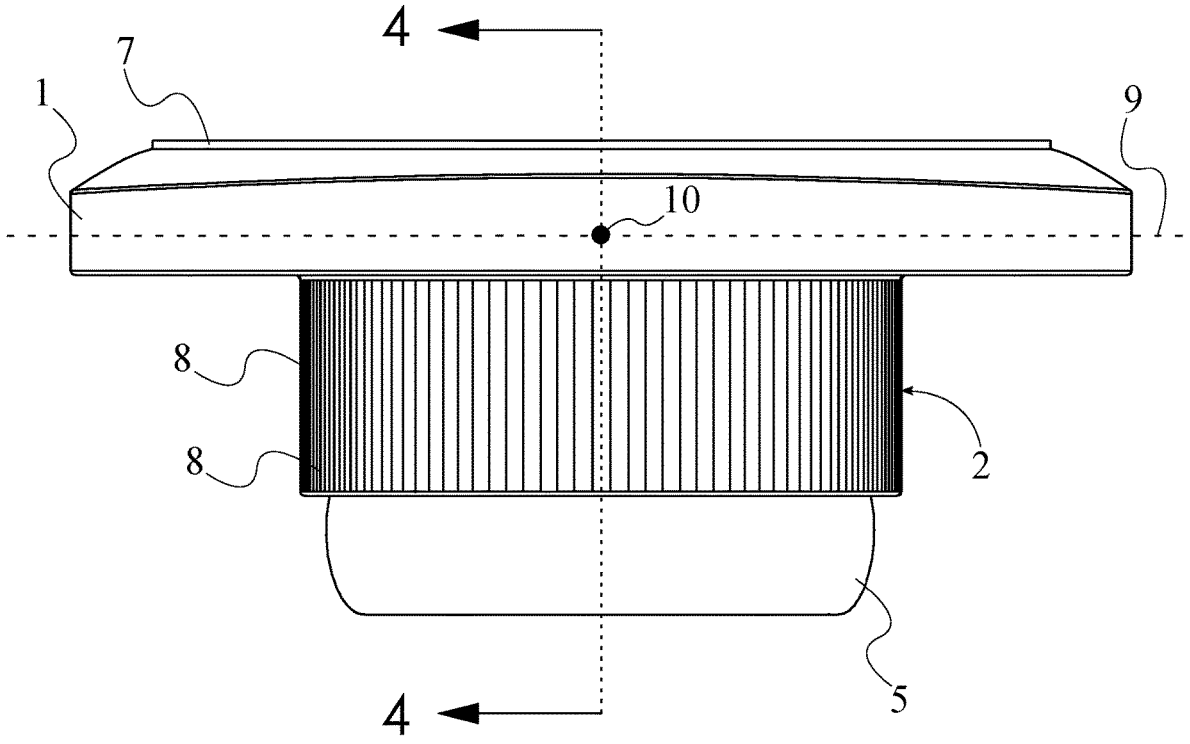
FIG. 3 is a front view of the present invention.
Figure 4:
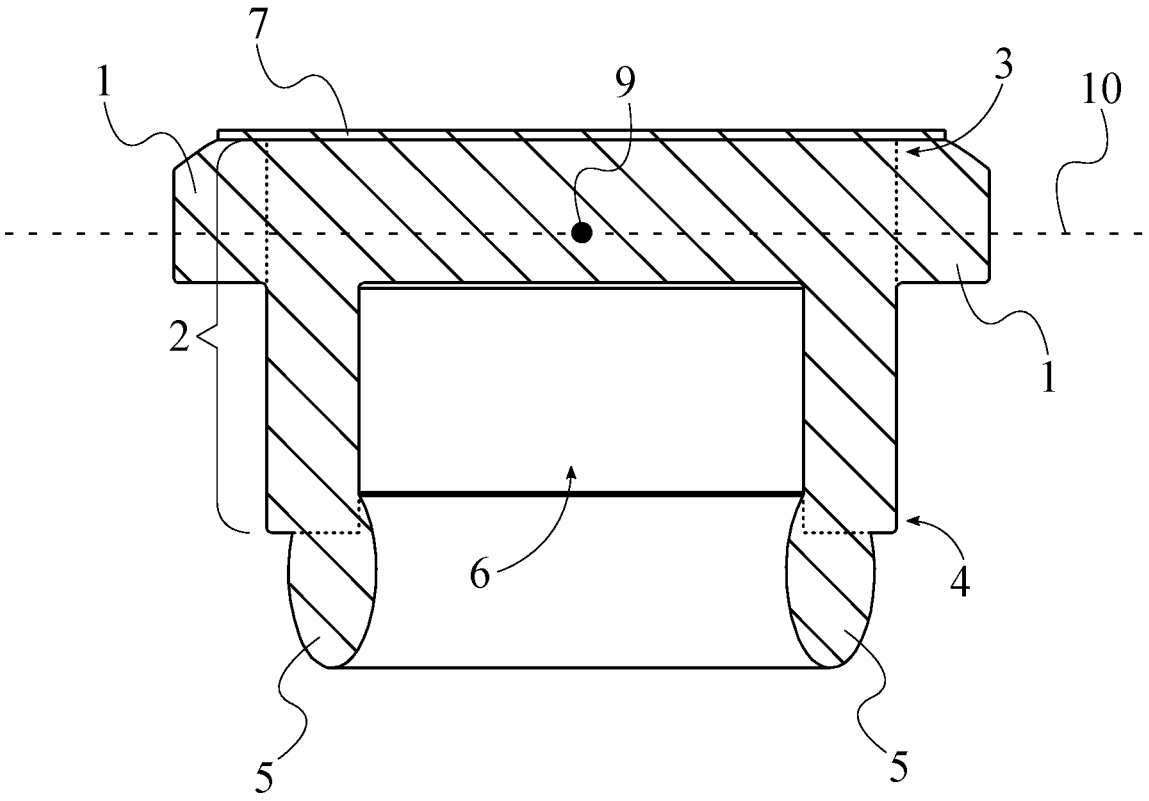
FIG. 4 is a cross-sectional view taken along line 4-4 in FIG. 3.
Figure 5:
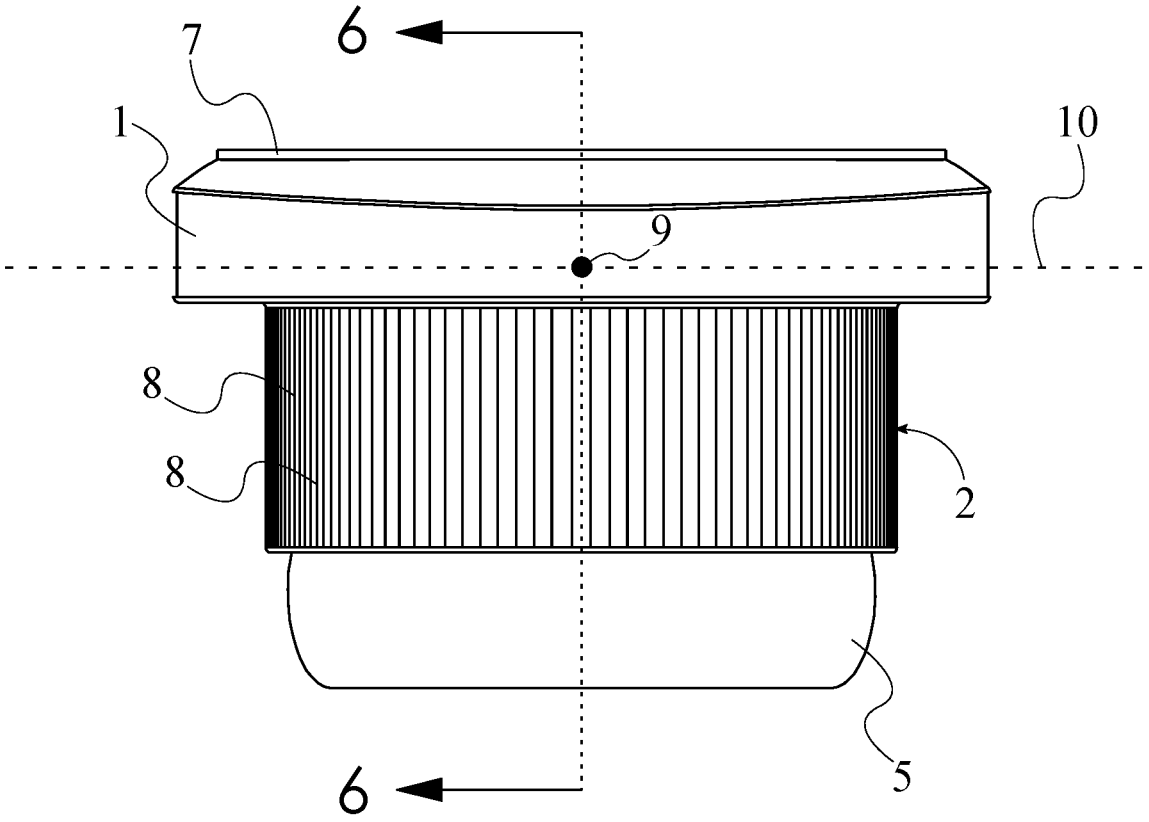
FIG. 5 is a side view of the present invention.
Figure 6:
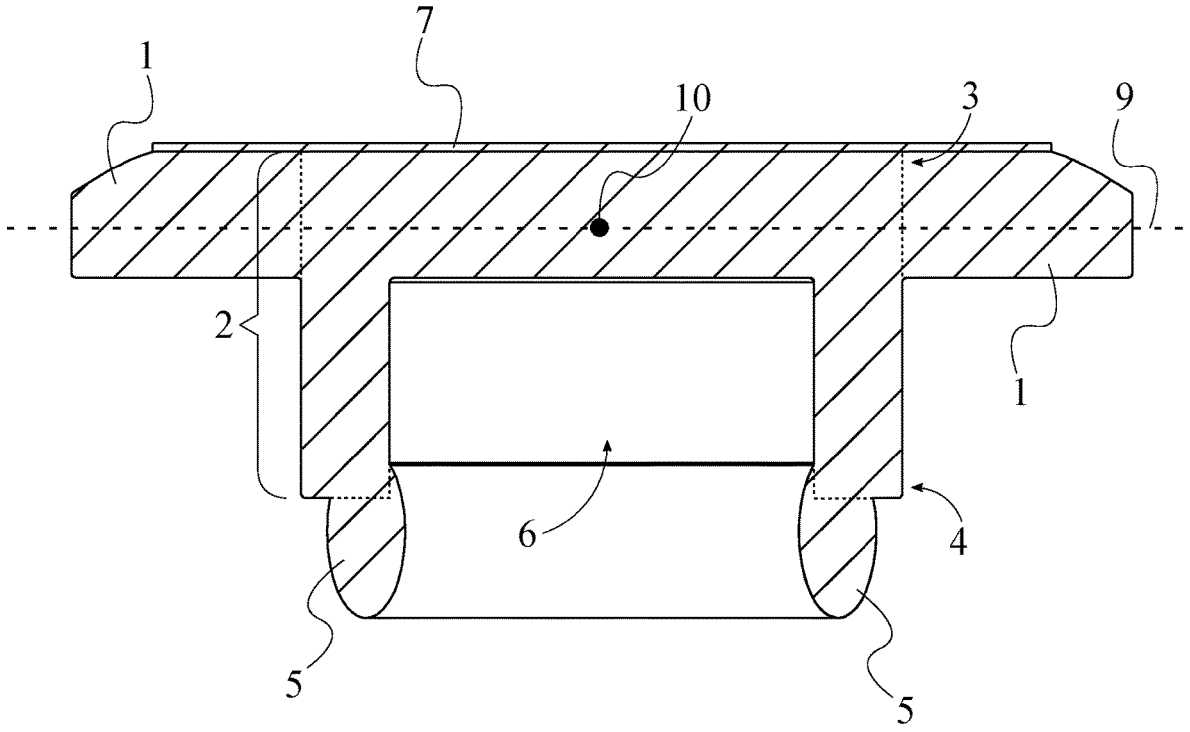
FIG. 6 is a cross-sectional view taken along line 6-6 in FIG. 5.

Furthermore, the oblong shape may be such that the present invention fits comfortably into a user's hand. To this end, a major axis 9 of the flange 1 may be 3.3 inches, and a minor axis 10 of the flange 1 may be 2.4 inches, as shown in FIGS. 3 and 5. Thus, the flange 1 fits conveniently into a user's hand and results in more intuitive application of the present invention.

The primary cavity 6 must be of a suitable depth to support a variety of bottle caps. To this end, a depth of the primary cavity 6 may be between 0.75 inches and 1.5 inches. This arrangement ensures that the primary cavity 6 is able to adequately maintain the position of a retained bottle cap during use.

Although the invention has been explained in relation to its preferred embodiment, it is to be understood that many other possible modifications and variations can be made without departing from the spirit and scope of the invention as hereinafter claimed.

What is claimed is:

1. A bottle-top adapter comprising:
a flange;
a prismatic body;
a bottle-sealing lip;
a primary cavity;
a writable panel;
a plurality of grip ridges;
the prismatic body comprising a first base and a second base;
the first base and the second base being positioned opposite to each other about the prismatic body;
the primary cavity being concentrically positioned to the prismatic body;
the primary cavity traversing into the prismatic body from the second base;
the flange being laterally connected around the prismatic body, adjacent to the first base;
the bottle-sealing lip being connected onto the second base;
the bottle-sealing lip being positioned around the primary cavity;
the bottle-sealing lip being positioned external to the primary cavity;
the writable panel being connected onto the first base;
the flange being positioned around the writable panel;
each of the plurality of grip ridges being positioned along the prismatic body;
the plurality of grip ridges being radially distributed about the prismatic body;
each of the plurality of grip ridges being laterally connected to the prismatic body;
the flange being an oblong shape;
the flange, the prismatic body, and bottle-sealing lip being made of a semirigid polymeric material;
the writable panel being made of a rigid material.

2. The bottle-top adapter as claimed in claim 1, wherein the writable panel is a miniaturized whiteboard.

3. The bottle-top adapter as claimed in claim 1, wherein the semirigid polymeric material is silicone.

4. The bottle-top adapter as claimed in claim 1, wherein a major axis of the flange is 3.3 inches, and wherein a minor axis of the flange is 2.4 inches.

5. The bottle-top adapter as claimed in claim 1, wherein a depth of the primary cavity is between 0.75 inches and 1.5 inches.

* * * * *